United States Patent [19]

Shikama et al.

[11] Patent Number: 4,931,626

[45] Date of Patent: Jun. 5, 1990

[54] PIC THERMISTOR DEVICE HAVING HEAT RADIATION FINS WITH ADJUSTABLE TEMPERATURE REGULATING GUIDE PLATES

[75] Inventors: Takashi Shikama; Asami Wakabayashi; Kiyofumi Torii, all of Nagaokakyo, Japan

[73] Assignee: Murata Manufacturing Co., Ltd., Japan

[21] Appl. No.: 322,909

[22] Filed: Mar. 10, 1989

[30] Foreign Application Priority Data

Mar. 10, 1988 [JP] Japan ..... 63-57237

[51] Int. Cl.[5] ..... H05B 3/00; H01C 7/02; F28F 3/02; F28F 27/00

[52] U.S. Cl. ..... 219/540; 165/96; 219/365; 219/375; 219/505; 219/530; 338/22 R

[58] Field of Search ..... 219/202, 365, 375, 376, 219/381, 382, 369, 370, 341, 530, 540, 541, 552, 553, 504, 505; 338/22 R; 165/96, 80.2, 80.3

[56] References Cited

U.S. PATENT DOCUMENTS

| | | | |
|---|---|---|---|
| 1,830,327 | 11/1931 | Modime | 165/96 |
| 3,686,541 | 8/1972 | Livezey et al. | 165/80.3 X |
| 4,414,052 | 11/1983 | Habata et al. | 219/540 X |

FOREIGN PATENT DOCUMENTS

| | | | |
|---|---|---|---|
| 243077 | 10/1987 | European Pat. Off. | 219/540 |
| 53-125641 | 11/1978 | Japan | 219/505 |
| 54-19233 | 2/1979 | Japan | 219/505 |
| 54-37932 | 3/1979 | Japan | 338/22 R |
| 58-39042 | 3/1983 | Japan | 219/540 |
| 312124 | 10/1971 | U.S.S.R. | 165/96 |
| 2076270 | 11/1981 | United Kingdom | 219/540 |

*Primary Examiner*—Anthony Bartis

*Attorney, Agent, or Firm*—Ostrolenk, Faber, Gerb & Soffen

[57] ABSTRACT

A PTC thermistor device includes a heat generator containing a PTC thermistor unit, and heat radiators thermally coupled thereto. Each of heat radiators includes a plate, one main surface of which is adhered onto the heat generator, and a number of fins integrally formed on the other main surface of the plate. Since the plates of the heat radiators are thermally coupled to the heat generator, respectively, heat generated by the PTC thermistor unit is radiated from the fins through the plates. Free ends of respective sets of fins form opening portions, and guide plates are disposed above and below the respective opening portions so as to prevent air from escaping through the opening portions. If the guide plates are movable guide plates and are moved, an opening degree of each opening portion covered by each of the movable guide plates is changed such that temperature of warm air blown-out from an air outlet side can be adjusted or controlled.

5 Claims, 4 Drawing Sheets

PIC THERMISTOR DEVICE HAVING HEAT RADIATION FINS WITH ADJUSTABLE TEMPERATURE REGULATING GUIDE PLATES

BACKGROUND OF THE INVENTION

1. Field of the Invention

The present invention relates to a PTC thermistor device. More specifically, the present invention relates to a PTC thermistor device which includes heat radiation fins thermally coupled to a PTC thermistor unit and which is utilized as a heat source for a drier, an air heater or the like, for example.

2. Description of the Background Art

Conventionally, PTC thermistor devices of the foregoing, general type are well known.

In a prior art device a wherein heat radiator of corrugated fins is utilized, portion of fan-impelled air sent into spacings formed by heat radiation fins often escapes from an opening portion of the fins without reaching an air outlet side. The portion of the air thus escaping on the way to the air outlet side does not contribute to warm air to be air outlet from the blowout side and thus reduces the amount, or volume, of the warm air, resulting in reduced thermal efficiency of a heat source.

SUMMARY OF THE INVENTION

Therefore, a principal object of the present invention is to provide a novel PTC thermistor device with a number of heat radiation fins.

Another object of the present invention is to provide a PTC thermistor device capable of preventing air from escaping from an opening portion of heat radiation fins.

Another object of the present invention is to provide a PTC thermistor device in which thermal efficiency cannot be lowered.

A PTC thermistor device in accordance with the present invention comprises a PTC thermistor unit; a heat radiator including a plate thermally coupled to the PTC thermistor unit and a number of fins integrally formed on the plate, free ends of respective fins forming an opening portion; and a guide plate disposed such that the opening portion can be covered by the guide plate.

When heat is generated by the PTC thermistor unit, such heat is radiated from the fins of the heat radiator through the plate thereof. At this time, if cool air is blown-into an air inlet side by, for example, a fan in a direction parallel with surfaces of the fins, the cool air is heated by the heat and becomes warm air which is blown-out from the air-outlet. The cool air is prevented from escaping through the opening portion before reaching the air outlet side by the guide plate which is disposed above or below the opening portion of the fins.

In accordance with the present invention, since the guide plate prevents the air from escaping through the opening portion of the heat radiation fins, reduction of the amount, or volume, of the warm air and, thus, the thermal efficiency due to "escaping" of the air does not occur.

If the guide plate is constructed as a movable guide plate and the movable guide plate is moved so as to adjust or control the opening degree of the opening portion covered by the movable guide plate, since an amount of air escaping from the opening portion can be adjusted or controlled such that externally-induced temperature of the PTC thermistor unit can be adjusted or controlled. On the other hand, the PTC thermistor unit has a temperature self-regulating function wherein the amount of heat generated by the PTC thermistor unit changes in response to the externally-induced temperature. Therefore, by moving the movable guide plate, it is possible to control the heat amount from the PTC thermistor unit, that is, the temperature of the warm air to be blown-out from the air outlet side. Therefore, if such a movable guide plate is utilized, a variable temperature heater is realized by a simple structure.

The foregoing objects and other objects, features, aspects and advantages of the present invention will become more apparent from the following detailed description of the embodiments of the present invention when taken in conjunction with accompanying drawings.

Figure 4:
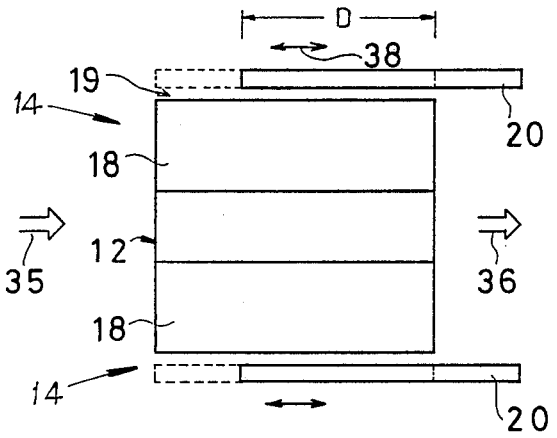
FIG. 4 is an illustrative view showing another embodiment in accordance with the present invention.
Figure 7:
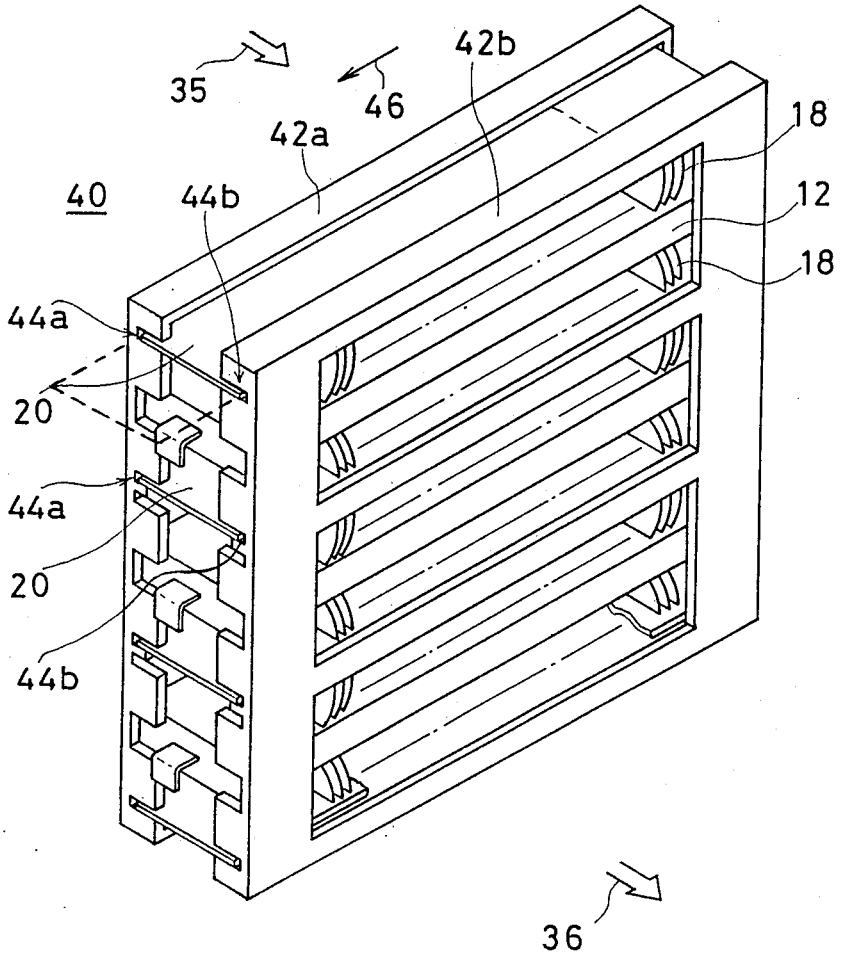

The FIG. 7 is a perspective view showing one example of a heater in accordance with FIG. 4 embodiment.

DETAIL DESCRIPTION OF THE PREFERRED EMBODIMENTS

Figure 1:
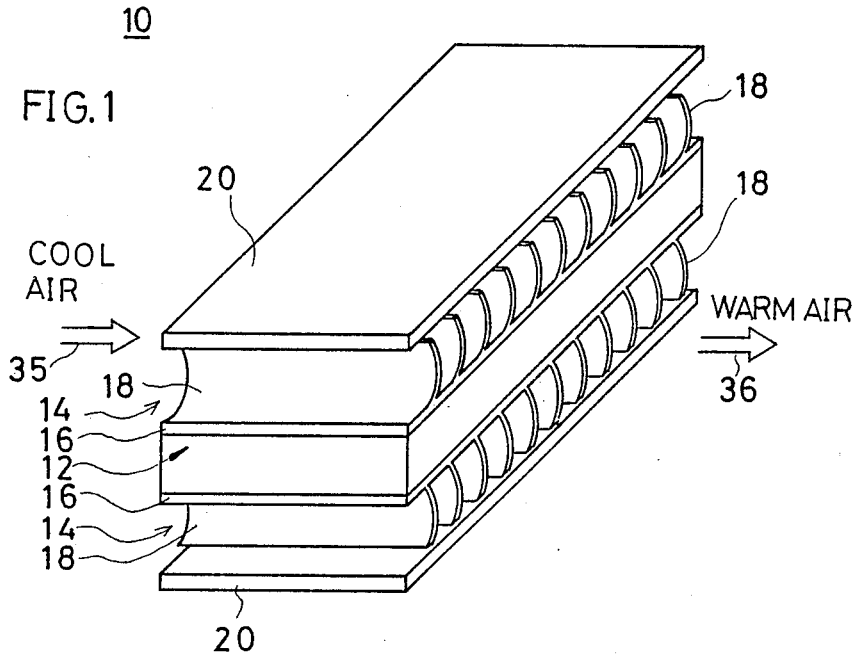
FIG. 1 is a perspective view showing one embodiment in accordance with the present invention.

With reference to FIG. 1, a PTC thermistor device 10 in accordance with this embodiment includes a heat generator 12 and heat radiators 14 thermally coupled to the heat generator 12, respectively.

Each of the heat radiators 14 includes a plate 16 and a number of heat radiation fins 18, and is integrally made from a metal having a good thermal conductivity, such as aluminum. In this embodiment shown, two heat radiators 14 are disposed so as to sandwich the heat generator 12. More specifically, respective one main surfaces of the plate 16 of the heat radiators 14 are adhered or fixed to surfaces of the heat generator 12 to be thermally coupled thereto and, on the respective other main surfaces of the plates 16, a number of fins 18 are integrally formed, respectively so to stand up, or project outwardly. For example, a single aluminum plate (not shown) is selectively planned away by a plane (not shown) at respective positions where the fins 18 are to be formed, whereby the plate 16 and the fins 18 are integrally formed. As best seen from FIG. 2, free ends of respective fins 18 are disposed within the same plane or level to form opening portions 19 of fins 18.

Above and below the opening portions 19 of the fins 18, guide plates 20 are respectively disposed so as to cover the same. The guide plates 20 can be made from an arbitrary material such as a synthetic resin, mica, metal or the like; however, it is preferable that such a material have heat-resistance and sufficient mechanical strength with respect to wind or air pressure.

Figure 2:
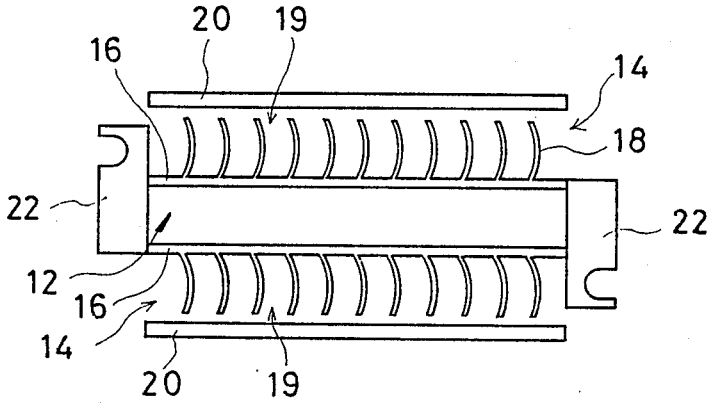
FIG. 2 is a front view of FIG. 1 embodiment.

In addition, the guide plate 20 can be attached to an assembly composed of the heat generator 12 and the heat radiators 14 in a one-piece fashion. However, the guide plates 20 may be formed separately from such an assembly. More specifically, in incorporating the assembly within an equipment such as a drier, air heater or the like, the guide plates 20 may be mounted in the vicinity of the air outlet side of the fins 18 by utilizing mounting portions 22 as shown in FIG. 2.

Figure 3:
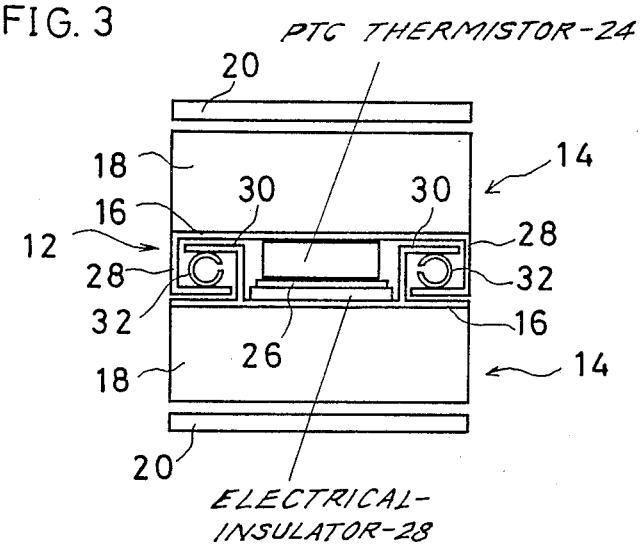
FIG. 3 is a side view of FIG. 1 embodiment.

Now, with reference to FIG. 3, the heat generator 12 includes a PTC thermistor unit 24 as a heat generation element, which is disposed such that one electrode formed on one main surface of the PTC thermistor unit 24 can be directly contacted with the plate 16 of the upper heat radiator 14 and the other electrode formed on the other main surface of the PTC thermistor unit 24 can be directly contacted with a terminal plate 26 made of metal. The terminal plate 26 is placed on the plate 16 of the lower heat radiator 14 via an electrical insulation layer 28 made of alumina or the like, for example. In addition, it is desirable that the insulation layer 28 is made of a material having a good thermal conductivity such that the plate 16 of the lower heat radiator 14 can be thermally coupled to the PTC thermistor unit 24.

In embodiment shown, at both side ends of the upper plate 16, bent portions 28 are formed by bending the same downward in a "U" letter shape in cross-section. On the other hand, at both side ends of the lower plate 16, bent portions 30 are also formed by bending the same upward in a "U" letter shape in cross-section so as to face the bent portions 28 at intervals. The bent portions 30 are formed slightly inside the bent portions 28. Then, springs 32 having a "C" letter shape in cross-section are inserted in the intervals between the bent portions 28 and 30. The bent portions 28, that is, the upper plate 16, is pressed downward by the springs 32 and the bent portions 30, that is, the lower plate 16, is pressed downward by the springs 32. Therefore, electrodes of the PTC thermistor unit 24 are surely adhered to the upper plate 16 and the terminal plate 26 to be electrically connected to the same. Then, by applying a suitable voltage between the plate 16 of the upper heat radiator 14 and the terminal plate 26, electric power can be supplied to the PTC thermistor unit 24.

In the PTC thermistor device 10 thus constructed, when electric power is supplied to the PTC thermistor unit 24, such unit generates heat. The heat thus generated is conducted to the plates 16 thermally coupled to the PTC thermistor unit 24 and, in turn, to respective fins 18. Therefore, if cool air is blown in by a fan (not shown) in a direction indicated by an arrow 35 in FIG. 1, the cool air contact the fins 18 and the heat being radiated therefrom, becoming warm air which is blown out in a direction indicated by an arrow 36 in FIG. 1. At this time, if there are no guide plates 20, the cool air often escapes from the opening portions 19 (FIG. 2) before passing throughout the fins 18. However, in this embodiment, since the cool air is prevented from escaping from the opening portions 19 by the guide plate 20, reduction of the amount, or volume, of the warm air and, thus, the thermal efficiency due to such escaping of the cool air does not occur.

In addition, in mounting the above-described assembly onto equipment, in accordance with a shape or size of the air outlet of the equipment, spacings (not shown) may be formed between the fins 18 and such air outlet in the absence of the guide plates 20. In such a case, a portion of the cool air may be blown out through non-illustrated spacings by way of the fin opening portion 19 in similar manner as the warm exhaust air, being mixed with the warm exhaust air and thus lowering the temperature thereof. However, in the embodiment shown, such non-illustrated spacings can be advantageously covered by the guide plates 20 which cover the opening portions 19, and therefore, there is an advantage that it is possible to effectively prevent the temperature of the warm air from being lowered by mixing the cool air into the warm air being blown out.

FIG. 4 is an illustrative view showing another embodiment in accordance with the present invention. In FIG. 4, configuration of the heat generator 12 as shown in FIG. 3 is omitted. In this embodiment, the guide plates 20 are constructed such that the same can be moved in a direction indicated by arrow 38 in FIG. 4. Then, by moving the guide plates 20 in the direction indicated by the arrow 38 by means of suitable moving means (not shown), an opening degree of the opening portions 19, that is, the dimension D where the guide plates 20 and the fins 18 are superposed, can be adjusted.

Figure 5:
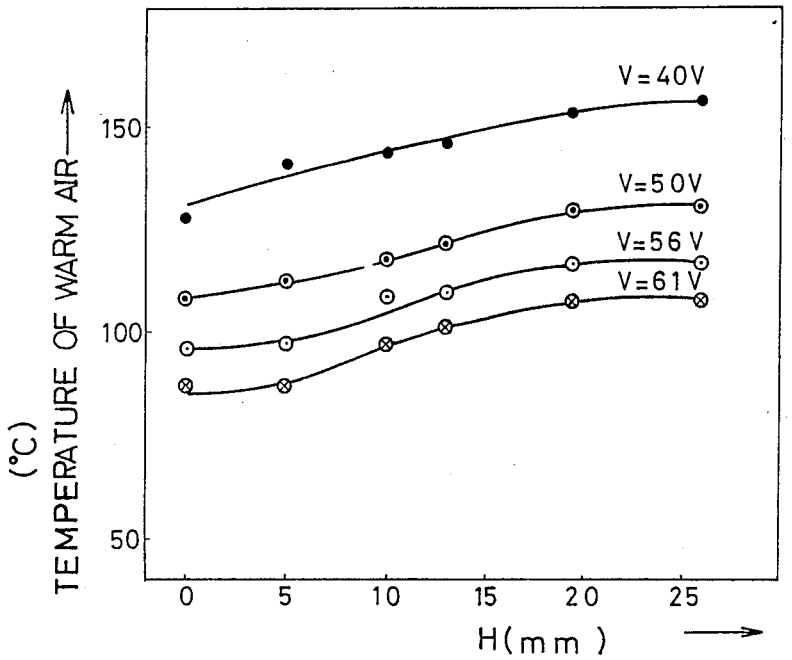
FIG. 5 is a graph showing change of temperature of warm air with respect to an opening degree of an opening portion covered by a guide plate in the FIG. 4 embodiment, wherein a capacity of a fan, that is, a voltage, is indicated as a parameter.

An amount, or volume, of cool air escaping from the fin opening portions 19 determines the degree of change of externally-induced temperature of the PTC thermistor unit 24. Therefore, by changing the opening degree of the opening portion 19, that is, the dimension D by means of the movable guide plates 20, it is possible to control the degree of change of the externally-induced temperature of the PTC thermistor unit 24. On the other hand, such a PTC thermistor unit has a temperature self-regulating function wherein the PTC thermistor unit changes its internally-generated heat amount in response to the its externally-induced temperature, as well known. Therefore, the PTC thermistor unit 24 responsively changes the amount of its internally-generated heat when its externally-induced temperature is thus changed. Therefore, by changing the dimension D, that is, the opening degree of the opening portion 19 by the movable guide plate 20, as shown in FIG. 5, if the capacity of the fan, that is, the voltage which drives the fan is constant; the PTC thermistor 24 is urged to generate less heat as the dimension D becomes shorter and more heat as the dimension D becomes longer. Thus, if the amount of the heat internally generated by the PTC thermistor unit 24 is changed, the temperature of the warm air to be blown out from the air outlet side is also changed. Thus, it is possible to implement a variable temperature heater simply by changing the opening degree of the opening portions 19 covered by the movable guide plate 20.

In regard to a conventional corrugated fin provided with a guide plate, the use of aluminum blazing for mechanical strength, results in a fixed guide plate and, therefore, it is impossible to obtain a variable temperature function as described above.

Figure 6:
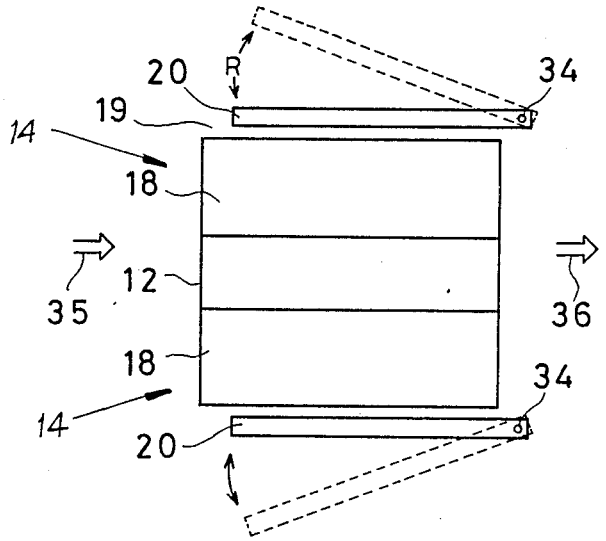
FIG. 6 is an illustrative view showing another embodiment in accordance with the present invention.

In order to change the opening degree of the opening portions 19 by the movable guide plate 20 as described above, another embodiment as shown in FIG. 6 may be utilized. In this embodiment, the movable guide plate 20 is supported by a shaft 34 at an end of the air outlet side for pivotal movement of such plate. Therefore, the movable guide plate 20 is able to be opened or closed with respect to the fin-opening portions 19. Then, by changing the opening degree R of the movable guide plate 20 by suitable means (not shown) for moving the movable guide plate 20, similar to the FIG. 4 embodiment, it is possible to obtain realize a temperature-varying mechanism.

FIG. 7 is a perspective view showing one example of a specific heater manufactured in accordance with the FIG. 4 embodiment. A heater 40 includes frames 42*a* and 42*b* made of a heat-resistant synthetic resin. The aforementioned assembly composed of the heat generator 12 and the heat radiators 14 is sandwiched and held by the frames 42*a* and 42*b*. At the opposite inside portions of the frame 42*a* and 42*b*, grooves 44*a* and 44*b* are formed to be extended in a longitudinal direction at positions opposite each other. By cooperation of the grooves 44*a* and 44*b*, the movable guide plate 20 is slibody held in a longitudinal direction of the grooves 44*a* and 44*b*. In addition, it is necessary to form the grooves 44*a* and 44*b* in the vicinity of the fins 18. Then, if the movable guide plates 20 are slid in a direction indicated by an arrow 46, the fin-opening degree of the opening portions 19 (FIG. 2) can be adjusted, resulting in a change of temperature of the warm air blown out in a direction indicated by an arrow 36.

In addition, in any one of the above-described embodiments, the guide plate 20 is illustrated as being relatively thin. However, to implement the guide plate 20, an arbitrary member having a wall surface capable of implementing the function of covering the fin-opening portions 19 can be utilized. For example, a block-like guide plate having a larger thickness may be utilized, or concave and convex portions or curved portions may be formed on the surface thereof. If the concave and convex portions or curved portions are formed, it is possible to easily adjust the opening degree of the guide plate 20 by utilizing the same.

Although the present invention has been described and illustrated in detail, it is clearly understood that the same is by way of illustration and example only and is not to be taken by way of limitation; the spirit and scope of the present invention being limited only by the terms of the appended claims.

What is claimed is:

1. A PTC thermistor device, comprising:

a PTC thermistor unit;

a heat radiation member including a plate thermally coupled to said PTC thermistor unit and a number of fins formed on the plate, free ends of said fins forming opening portions therebetween; and a guide plate disposed so as to cover said opening portions and being moveable relative to the free ends of said fins, whereby an opening degree of said opening portions can be changed.

2. A PTC thermistor device in accordance with claim 1, wherein said movable guide plate can be linearly moved in a direction parallel with a plane including said free ends of said fins.

3. A PTC thermistor device in accordance with claim 1, wherein said movable guide plate is pivotally supported by a shaft in the vicinity of said fins for movement toward and away from the free ends of said fins.

4. A PTC thermistor device in accordance with claim 1, further comprising means for pressure-contacting said plate of said heat radiation member to said PTC thermistor unit.

5. A PTC thermistor device in accordance with claim 4, wherein said means includes a spring member.

* * * * *